US007401417B2

(12) United States Patent
Rydell et al.

(10) Patent No.: US 7,401,417 B2
(45) Date of Patent: Jul. 22, 2008

(54) METHOD AND A DEVICE FOR DRYING OR HEAT TREATMENT OF A WEB-FORMED MATERIAL

(75) Inventors: Ingemar Rydell, Växjö (SE); Ake Ringqvist, Kalvsvik (SE); Heikki Salo, Växjö (SE)

(73) Assignee: Andritz Fiber Drying Aktiebolag, Vaxjo (SE)

( * ) Notice: Subject to any disclaimer, the term of this patent is extended or adjusted under 35 U.S.C. 154(b) by 42 days.

(21) Appl. No.: 10/539,398

(22) PCT Filed: Dec. 16, 2003

(86) PCT No.: PCT/EP03/14316

§ 371 (c)(1),
(2), (4) Date: Dec. 15, 2005

(87) PCT Pub. No.: WO2004/057254

PCT Pub. Date: Jul. 8, 2004

(65) Prior Publication Data

US 2006/0150434 A1 Jul. 13, 2006

(30) Foreign Application Priority Data

Dec. 20, 2002 (SE) ..... 0203803

(51) Int. Cl.
*F26B 3/06* (2006.01)

(52) U.S. Cl. ..... 34/487; 34/451; 34/507; 34/510

(58) Field of Classification Search ..... 34/77, 34/78, 636, 638, 639, 209, 210, 212, 218, 34/219, 451, 487, 507, 510, 131; 432/59, 432/72

See application file for complete search history.

(56) References Cited

U.S. PATENT DOCUMENTS

| | | | | |
|---|---|---|---|---|
| 3,849,904 | A | 11/1974 | Villalobos | 34/155 |
| 4,133,636 | A * | 1/1979 | Flynn | 34/636 |
| 4,253,247 | A | 3/1981 | Bergstrom | 34/155 |
| 4,365,423 | A | 12/1982 | Arter et al. | 34/23 |
| 4,977,687 | A | 12/1990 | Boissevain | 34/51 |
| 5,337,586 | A * | 8/1994 | Ronchi | 34/638 |
| 5,967,770 | A * | 10/1999 | Heine et al. | 432/59 |
| 6,735,882 | B2 * | 5/2004 | Takahashi | 34/636 |

* cited by examiner

*Primary Examiner*—Jiping Lu
(74) *Attorney, Agent, or Firm*—Alix, Yale & Ristas, LLP

(57) ABSTRACT

When drying a web-formed material, the web-formed material is passed, in contact with a gas-permeable dryer screen, through a drying plant. One or more fans blow hot process air against, and through, the web-formed material in order to dry it. A chamber, surrounding the fan or the fans, has a limiting surface that is essentially parallel to the surface of the web-formed material. This limiting surface has an opening that extends essentially across the whole width of the web-formed material. A distributing member, in the form of an arcuate perforated, sheet-formed element, placed outside the chamber, covers the opening completely. With the distributing member a first flow of process air is divided into a large number of jets, distributed over essentially the whole of the angular area that faces the web-formed material. Thereafter, the jets are allowed to mix with one another again to form a second flow of process air, which is passed through a flat perforated, sheet-formed element that is positioned close to and extends over essentially the whole of the web-formed material, and then against and through the web-formed material lying on the gas-permeable dryer screen.

9 Claims, 3 Drawing Sheets

METHOD AND A DEVICE FOR DRYING OR HEAT TREATMENT OF A WEB-FORMED MATERIAL

CROSS-REFERENCE TO RELATED APPLICATIONS

This is the national stage of International Application No. PCT/EP2003/014316 filed Dec. 16, 2003 and which designated the United States.

Technical Field

The present invention relates to a method for drying or heat treatment of a web-formed material, preferably glass fibre. The web-formed material is passed, in contact with a gas-permeable dryer screen, through a drying plant. Hot process air is blown against, and through, the web-formed material, in order to dry and/or heat-treat said material.

For the purpose of obtaining an equalized velocity distribution of the process air through the web-formed material, a pressure drop is generated in a zone which, on the high-pressure side of the web-formed material, lies close to and extends across essentially the whole web-formed material.

Distribution members serve to distribute the process air in the region upstream of this pressure-drop zone.

The present invention also relates to a device suitable for carrying out the method.

BACKGROUND

Web-formed materials, such as paper or pulp, are usually dried either in a contactless manner by blowing hot air against the web-formed material, or by contact with heated surfaces, primarily cylinders.

In cylinder drying of a web-formed material, for example paper, the web-formed material is heated by heated cylinders against which the web-formed material is pressed by the web tension and/or with the aid of a felt or a dryer screen.

In contactless drying, the web-formed material is usually passed back and forth through a plurality of drying decks, floating between upper and lower blow boxes, which blow out hot process air against the web-formed material, in order to dry said material.

If the web-formed material is sufficiently porous, one useful method is to blow and/or suck process air or other suitable drying medium through the material, so-called through drying. The web-formed material is then suitably supported by a gas-permeable dryer screen or by perforated cylinders during the drying. Through drying is suitable for drying, for example, soft crepe paper (soft tissue, non-woven) and glass fibre. The concept drying is used in a broad sense in the following so that it also includes extraction of steam other than water and supply of heat for the purpose of, for example, curing a binder or achieving other chemical changes.

The water (or other substance) which, in the form of steam, leaves the web-formed material is mixed with and discharged by the process air. To be able to retain the drying effect, therefore, part of the process air must be discharged as exhaust air and be replaced by drier and preferably hot supply air. This, of course, occurs to such a limited extent that such a high moisture content is maintained in the exhaust air that condensation and corrosion on exposed parts can only just be avoided. The main part of the process air is recirculated.

The process air is heated by the supply of heat to the mixture of supply air and recirculated process air. This often takes place by recuperative heat exchange, where the heating medium is low-pressure steam or medium-pressure steam, but may also take place in other ways, for example by means of one or more gas burners placed directly in the recirculation flow. In case of an increased drying requirement, the supply of heat is increased and in case of a decreased drying requirement, the supply of heat is reduced.

In through drying, the distribution of the velocity and temperature of the process air over the surface of the web are very sensitive parameters. This is true to a particularly high degree when drying a wet-formed glass-fibre web. To ensure, as far as possible, at least a uniform velocity distribution, a perforated plate or the like is usually placed near the web-formed material on the upstream side. With this plate, a pressure drop is created which equalizes the differences in velocity to a certain extent. The higher the pressure drop, the better the equalization.

Increasing quality demands, however, have led to a situation where it is now difficult to fulfil the demands made with reasonable pressure drops.

It is a first object of the present invention to provide a through dryer for the web-formed material.

It is a second object of the present invention to provide a through dryer for a web-formed material, which dryer, with reduced pressure drop, achieves the desired conditions as regards distribution of velocity through the web-formed material.

It is a third object of the present invention to provide a through dryer for a web-formed material which fulfils higher demands as regards distribution of velocity through the web-formed material than what can be achieved using conventional technique.

It is a fourth object of the present invention to provide a through dryer for a web-formed material which permits the dried web-formed material to fulfil higher demands than what can be achieved using conventional technique.

SUMMARY OF THE INVENTION

The present invention relates to a method for drying and/or heat treatment of a web-formed material, preferably glass fibre. The web-formed material is passed, in contact with a gas-permeable dryer screen, through a drying plant. Hot process air is blown against, and sucked through, the web-formed material in order to dry or heat said material.

The water, or other substances, which in the form of steam leaves the web-formed material, is mixed with and discharged by the process air, at least part of which is recirculated whereas the non-recirculated process air is discharged as exhaust air and is replaced by a corresponding part of supply air with a low water content.

In order to obtain an equalized velocity distribution of the process air through the web-formed material, a pressure drop is generated in a zone which, on the high-pressure side of the web-formed material, lies close to and extends across essentially the whole web-formed material.

Distribution members are used to distribute the process air in the region upstream of said pressure-drop zone.

According to the present invention, a first flow of process air is formed, with a cross section extending essentially across the whole width of the web-formed material and the extent of which along the direction of movement of the web-formed material is considerably smaller than its extent perpendicular to the direction of movement of the web-formed material. This first flow has a direction of flow that is essentially perpendicular to the surface of the web-formed material.

The first flow of process air is divided into a large number of jets directed essentially in a plane defined by the direction of movement and the normal direction of the web-formed material, said jets being distributed over essentially the whole angular region facing the web-formed material. Thereafter, the jets are allowed to be mixed with one another again into a second flow of process air which is conducted through the pressure-drop zone and then against and through the web-formed material lying on the gas-permeable dryer screen.

The present invention also relates to a device for drying or heat treatment of a web-formed material, preferably glass fibre, comprising a gas-permeable dryer screen for transporting the web-formed material, as well as one or more fans blowing hot process air against, and sucking it through, the web-formed material, in order to dry or heat said material.

A chamber, surrounding the fan or fans, extends essentially across the whole width of the web-formed material. One or more distribution members, preferably located relatively near the fans, are adapted to distribute the process air.

Means generating a pressure drop, located on the high-pressure side of the web-formed material, lie close to and extend over essentially the whole web-formed material.

According to the present invention, the chamber has a limiting surface that is essentially parallel to the surface of the web-formed material. This limiting surface has an opening extending essentially across the whole width of the web-formed material. The extent of the opening along the direction of movement of the web-formed material is considerably smaller than its extent perpendicular to the direction of movement of the web-formed material. A distribution member, placed outside the chamber, covers the opening entirely. The distribution member consists of an arcuate perforated, sheet-formed element. The pressure-drop generating member consist of a plane perforated, sheet-formed element.

The present invention thus relates to a method and a device for so-called through drying of a web-formed material, preferably glass fibre. The drying of the web-formed material takes place at least substantially inside a housing that completely or essentially completely surrounds the drying plant. The drying plant is divided into several sections, through which the web-formed material is consecutively passed on a gas-permeable dryer screen.

In a loop that is separate for each section of the drying plant, the main part of the used process air is recirculated, mixed with supply air and heated to the desired temperature. The heating is often performed recuperatively, but may also be performed with one or more gas burners directly in the process-air flow. The magnitude of the flow is determined by fans placed downstream of the heating but upstream of the web-formed material, so that over pressure is applied only to the region between the fans and the web-formed material whereas underpressure prevails below the web-formed material and in the recirculation loop itself.

The fans are preferably radial fans, which on their high-pressure side have a chamber from which the process air flows against and through the web-formed material resting on the gas-permeable dryer screen.

The chamber has an opening facing the web-formed material.

The opening is placed in, or constitutes, one of the limiting surfaces of the chamber. The chamber may thus be completely without one wall and for this reason the theoretical delimitation of the chamber is called a limiting surface.

The opening has an extent along the direction of movement of the web-formed material that is considerably smaller than its extent perpendicular to the direction of movement of the web-formed material; it is preferably formed as a rectangle with its long sides perpendicular to the direction of movement of the web-formed material, and especially it may be formed by the extent of the chamber. A first flow of process air, with a direction of flow essentially perpendicular to the surface of the web-formed material, is conducted through this opening.

This first flow of process air is divided into a large number of jets directed essentially in a plane defined by the direction of movement and the normal direction of the web-formed material, the jets being distributed over essentially the whole of the angular region facing the web-formed material. The jets have thus essentially no component in a direction perpendicular to the direction of movement of the web-formed material lying in the plane of the web.

The division is performed with the aid of a distribution member that is placed outside the chamber and completely, or essentially completely, covers the opening. The distribution member is in the form of an arcuate perforated, sheet-formed element, for example a perforated plate.

The arcuate perforated, sheet-formed element is suitably, wholly or partially, formed as part of the envelope surface of a straight cylinder. It may, for example, be formed as part of the envelope surface of a straight circular cylinder, preferably essentially as half the envelope surface of a straight circular cylinder. It may also be formed as part of the envelope surface of a straight polygonal cylinder, for example as part of the envelope surface of a straight polygonal cylinder composed of essentially plane sub-elements, preferably essentially as half the envelope surface of a straight regular, polygonal cylinder.

The degree of perforation, in the arcuate perforated, sheet-formed element, should be lower in a central portion than at the sides. The perforation, in the arcuate perforated sheet-formed element, suitably consists of essentially circular holes which are formed with a rounded inlet and terminate in a neck projecting into the direction of flow of the process air.

With this distribution member, a large number of jets with essentially circular cross section are formed, and the jets are directed a certain distance after the first flow has been divided.

This distribution should take place such that the first flow of process air is divided into a large number of jets directed so that their paths do not intersect one another, preferably so that they are essentially isotropically outwardly-directed. The division may be made so that they are directed, section by section, in the same direction and/or so that the angular difference between two jets increases with the distance between the jets measured in the machine direction of the web-formed material.

The jets in a central section are suitably essentially anti-parallel to a normal to the web-formed material and other sections exhibit deviating directions with a successively increasing angle to the jets in the central section.

The degree of perforation in the arcuate sheet-formed element should be adapted such that the ratio of the total cross-section area of the jets to the total area is lower in a central portion, where the direction of the jets is essentially perpendicular to the web-formed material, than at the sides, where the direction of the jets lies essentially in the plane of the web-formed material. The optimal distribution of the holes and the size thereof will vary depending on the geometrical conditions.

When the first flow of process air, in the distribution member, has been divided into a large number of jets distributed in the manner described above, the jets are allowed to mix with one another again into a second flow of process air, which is conducted through the pressure-drop zone, through the pressure-drop generating member which suitably consists of a plane perforated, sheet-formed element, and then against and through the web-formed material lying on the gas-permeable dryer screen.

BRIEF DESCRIPTION OF THE DRAWINGS

The invention will now be described in greater detail with reference to the accompanying drawings, wherein FIG. 1 schematically shows the principle of a prior-art drying plant for a web-formed material.

DETAILED DESCRIPTION OF THE PREFERRED EMBODIMENT

Figure 1:
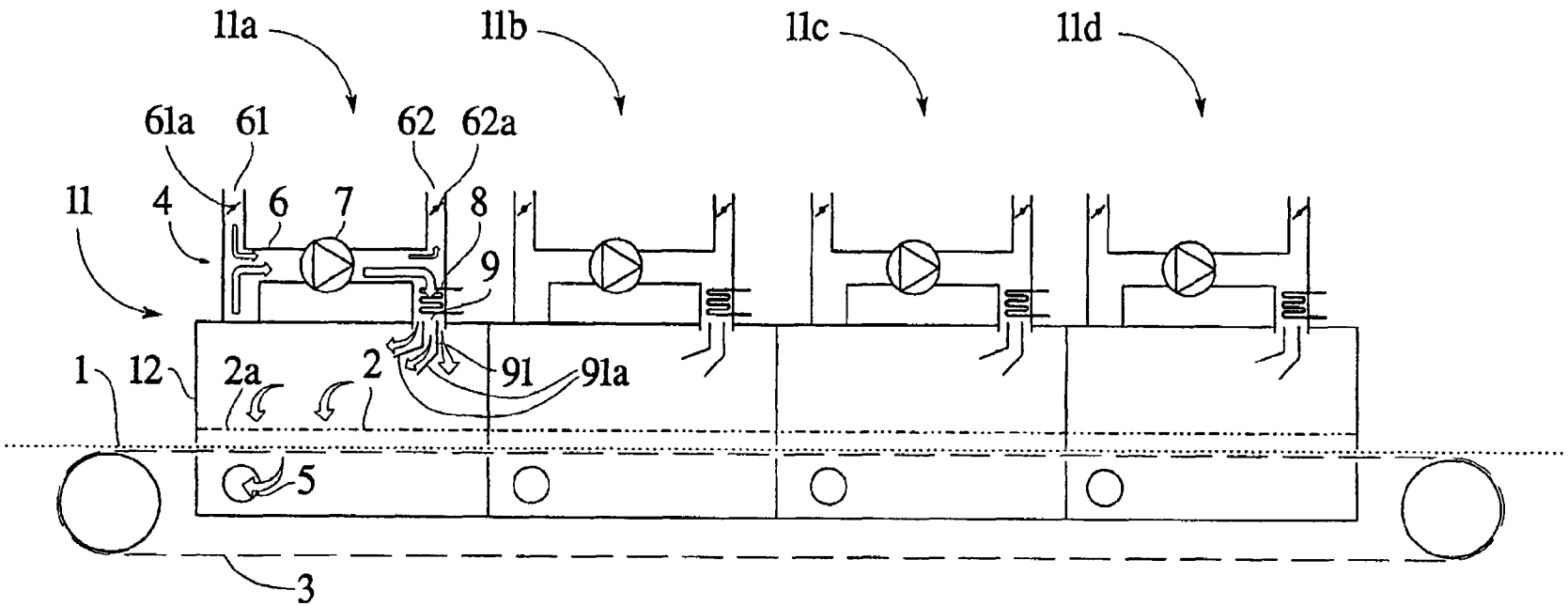

FIG. 1 shows a simplified side view of a drying plant 11 for a glass-fibre web 1. The drying plant 11 is enclosed in a housing 12 and comprises four drying sections 11*a*, 11*b*, 11*c*, 11*d*, separated by partitions. The glass-fibre web 1 is passed through the drying plant 11 in contact with a gas-permeable dryer screen 3, for example made of bronze. Associated with each drying section 11*a* etc. is a recirculation loop 4 comprising an inlet 5, a recirculation channel 6, a recirculation fan 7, a heater battery 8, and an outlet 9 in the roof of the housing 12. Above the glass-fibre web 1, at a distance of approximately 130 mm, there is a pressure-drop generating member 2 in the form of a perforated plate 2*a*.

The recirculation loop 4 is provided with an inlet 61 for supply air and an outlet 62 for exhaust air. A first control device 61*a* is mounted at the inlet 61, and a second control device 62*a* is mounted at the outlet 62.

The outlet 9 of the recirculation loop 4 is provided with a distribution member 91 consisting of guide vanes 91*a*.

Figure 2:
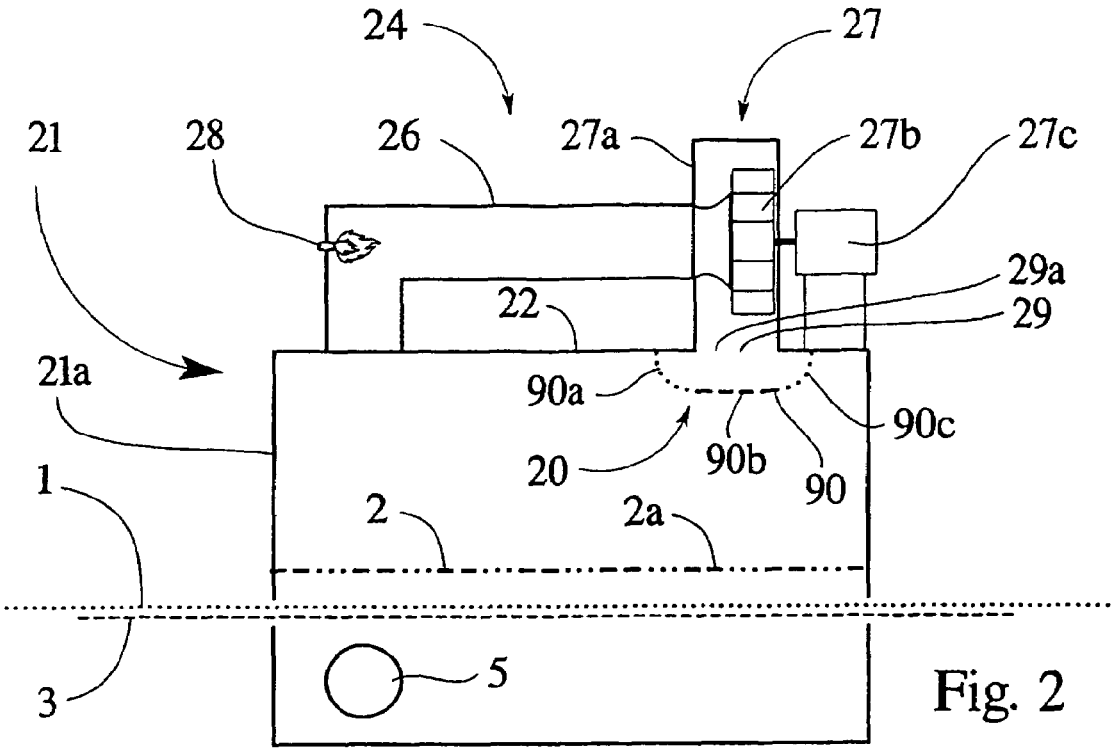
FIG. 2 schematically shows a section of a drying plant designed according to the present invention.

FIG. 2 shows in simplified form a section 21*a* of a drying plant 21, enclosed in a housing 22 and designed according to the present invention. Associated with the drying section 21*a* is a recirculation loop 24 comprising an inlet 5, a recirculation channel 26, a gas burner 28, a radial fan 27, a chamber 27*a* surrounding the impeller 27*b*, and an outlet 29 in the roof of the housing 22, as well as an inlet (not shown) for supply air and an outlet (not shown) for used process air.

The fan 27 is driven by an electric motor 27*c*. The outlet 29 of the recirculation loop 24 consists of an opening 29*a* in the chamber 27*a*, which is completely open downwards and thus has no floor.

The outlet 29 of the recirculation loop 24, that is, the opening 29*a* in the chamber 27*a* which is completely open downwards, is covered by a distribution member 20 in the form of an arcuate perforated plate 90 divided into three sections 90*a*, 90*b*, 90*c*. The central section 90*b* has a lower degree of perforation than the side sections 90*a* and 90*c*, although the difference is exaggerated to make it more clear.

The opening 29*a* has an extent along the direction of movement of the web-formed material that is considerably smaller than its extent perpendicular to the direction of movement of the web-formed material. It is preferably formed as a rectangle with its long sides perpendicular to the direction of movement of the web-formed material, and especially it may be formed by the extent of the chamber. A first flow of process air, with a direction of flow essentially perpendicular to the surface of the web-formed material, is conducted through this opening.

This first flow of process air is divided into a large number of jets directed essentially in a plane defined by the direction of movement and the normal direction of the web-formed material, the jets being distributed over essentially the whole of the angular region facing the web-formed material. The jets have thus essentially no component in a direction perpendicular to the direction of movement of the web-formed material lying in the plane of the web.

The division is performed with the aid of a distribution member that is placed outside the chamber and completely, or essentially completely, covers the opening. The distribution member is in the form of an arcuate perforated, sheet-formed element, for example a perforated plate.

Figure 3:
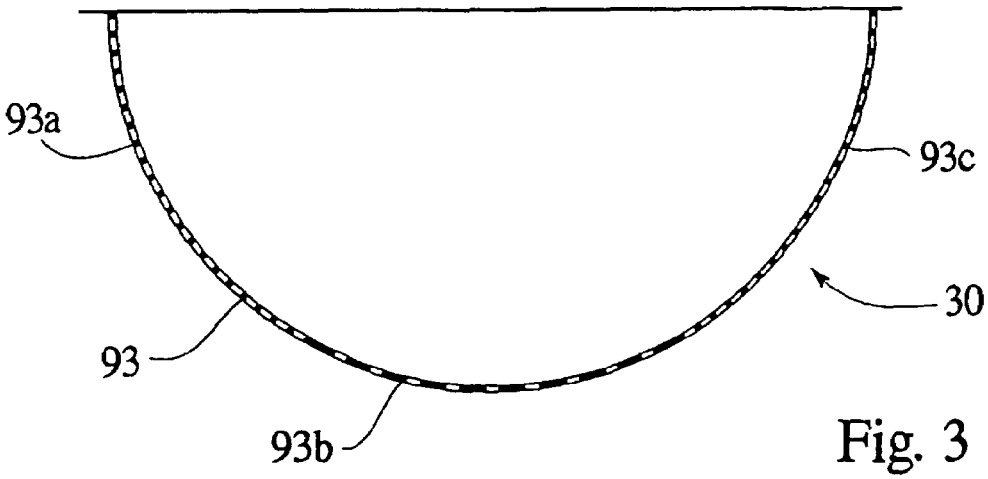
FIG. 3 schematically shows a first distribution member designed according to the present invention.

FIG. 3 shows, in somewhat more detail, the section through a first distribution member 30 in the form of a perforated plate 93 that constitutes half the envelope surface of a circular cylinder. The envelope surface is divided into three sections 93*a*, 93*b*, 93*c*. The central section 93*b* has a lower degree of perforation than the side sections 93*a* and 93*c*, although the difference is exaggerated to make it more clear.

Figure 4:
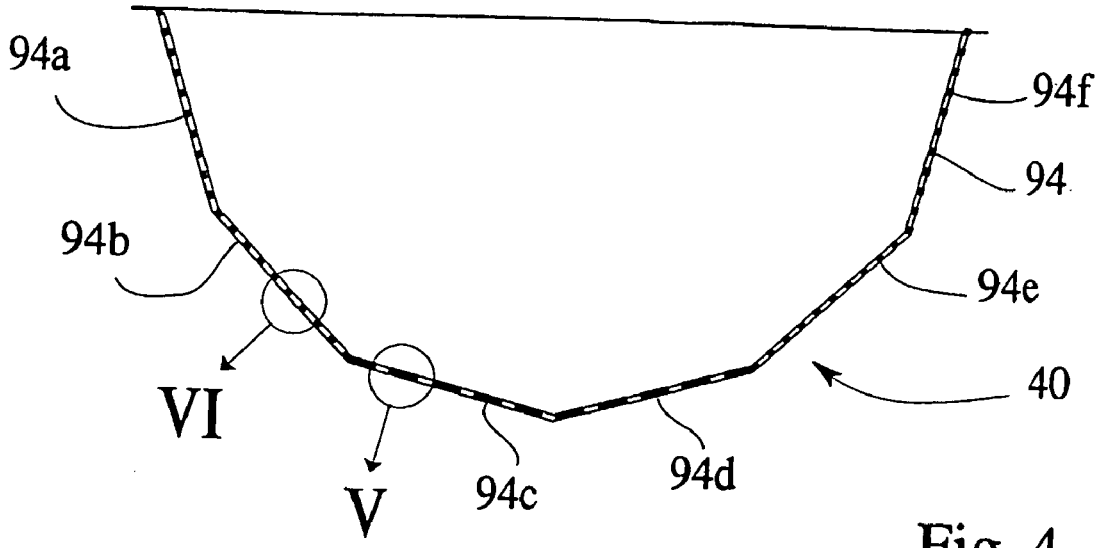
FIG. 4 schematically shows a second distribution member designed according to the present invention.

FIG. 4 shows, also in somewhat more detail, the section through a second distribution member 40 in the form of a perforated plate 94 that constitutes half the envelope surface of a cylinder, the cross section of which is a regular dodecagon. The envelope surface is divided into six sections 94*a*, 94*b*, 94*c*, 94*d*, 94*e*, 94*f*. The two central sections 94*c*, 94*d* have a lower degree of perforation than the four side sections 94*a*, 94*b*, 94*e*, 94*f*, although the difference is exaggerated to make it more clear.

Figure 5:
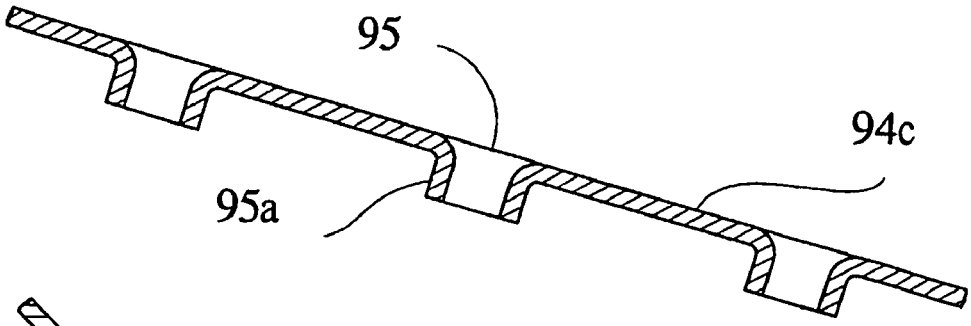
FIG. 5 shows a first detail of the distribution member according to FIG. 4.

FIG. 5 shows an enlarged detail of a section through the section 94*c* of the perforated plate 94 shown in FIG. 4. The detail shows three circular holes 95 with necks 95*a* pointing in the direction of flow. The proportions are somewhat distorted to make it more clear. The degree of perforation is approximately 6%.

Figure 6:
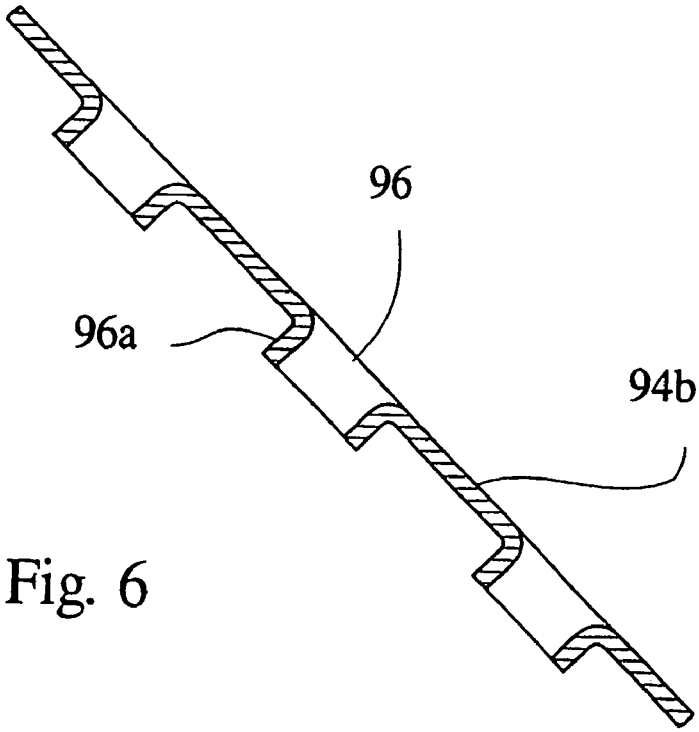
FIG. 6 shows a second detail of the distribution member according to FIG. 4.

FIG. 6 shows an enlarged detail of a section through the section 94*b* of the perforated plate 94 shown in FIG. 4. The detail shows three circular holes 96 with necks 96*a* pointing in the direction of flow. The proportions are somewhat distorted to make it more clear. The degree of perforation is approximately 8%.

The mode of operation of the invention is as follows.

The fan 27 creates an overpressure in the chamber 27*a* and hence blows a first flow of hot process air through the opening 29 against the distribution member 20. In the distribution member 20, the first flow is divided into a large number of jets passing through the holes in the arcuate perforated, sheet-formed element 90. Downstream of the distribution member 20, the jets are mixed into a second flow of process air flowing against the plane perforated plate 2*a* which distributes the flow over the web-formed material 1.

The fan 27 also creates an underpressure below the gas-permeable dryer screen 3, and this underpressure sucks the process air through the web-formed material 1 and the gas-permeable dryer screen 3. The process air is further sucked in, as a recirculation flow, through the inlet 5 and via the recirculation channel 26 past the gas burner 28, where the recirculation flow is heated to the desired temperature, back to the fan 27. Upstream of the gas burner 28, a part-flow is taken out as exhaust air, below the dryer screen 3, and dry air is added, in the recirculation channel 26, in a manner not shown.

The invention is not, of course, limited to the embodiments described above but may be varied in a plurality of ways within the scope of the appended claims.

Thus, for example, both the shape and the degree of perforation of the arcuate perforated, sheet-formed element (90, 93, 94) may be varied in a plurality of ways depending on the outer geometry and other circumstances, and the recirculation air may be heated by indirect (recuperative) heat transfer by means of, for example, a steam battery.

What is claimed is:

1. A method for drying or heat treating a web-formed material having a width, the method comprising:

transporting the web-formed material, in contact with a gas-permeable dryer screen, through a drying plant in a direction of transport;

establishing high and low-pressure sides of the web-formed material by blowing a hot process air against the web-formed material and drawing the process air through the web-formed material, to dry said material;

mixing water leaving the web-formed material with the process air;

discharging a first portion of the mixed water and process air as exhaust air and replacing the exhaust air with a corresponding portion of supply air with a low water content;

recirculating a second portion of the mixed water and process air;

generating a pressure drop in a zone disposed proximate to the high-pressure side of the web-formed material, the zone extending substantially the width of the web-formed material; and distributing the process air in a region upstream of the pressure-drop zone with a distribution member, the distribution member forming a first flow of process air having a width extending substantially across the width of the web-formed material and a length in the direction of transport of the web-formed material, the length of the first flow of process air being smaller than the width of the first flow of process air, the first flow of process air having a direction of flow substantially perpendicular to the surface of the web-formed material, dividing the first flow of process air into a plurality of jets directed substantially in a plane defined by the direction of transport and the normal direction of the web-formed material, said jets being distributed over substantially an angular region facing the web-formed material, and mixing the jets with one another again into a second flow of process air, the second flow of process air being conducted through the pressure-drop zone and then against and through the web-formed material lying on the gas-permeable dryer screen.

2. The method of claim 1 wherein dividing the first flow of process air includes directing substantially all of the jets such that the jet paths do not intersect one another.

3. The method of claim 2 wherein the jets are substantially isotropically outwardly-directed.

4. The method of claim 2 wherein the jets are section by section, directed in the same direction.

5. The method of claim 2 wherein the first flow of process air is divided such that a ratio of the total cross-section area of the jets to the total area is lower in a central portion, where the direction of the jets is substantially perpendicular to the web-formed material, than at the sides, where the direction of the jets lies substantially in the plane of the web-formed material.

6. The method of claim 2 wherein dividing the first flow of process air includes forming the jets with an substantially circular cross section.

7. The method of claim 6 wherein the jets are directed a certain distance after the first flow has been divided.

8. The method of claim 1 wherein dividing the first flow of process air includes directing the jets such that the angular difference between two jets increases with the distance between the jets measured in the direction of transport of the web-formed material.

9. The method of claim 1 wherein dividing the first flow of process air includes directing the jets such that the jets in a central section are antiparallel to a normal to the web-formed material and jets in any other sections exhibit deviating directions with a successively increasing angle to the jets in the central section.

* * * * *